US005167417A

United States Patent [19]

Stacey et al.

[11] Patent Number: 5,167,417

[45] Date of Patent: Dec. 1, 1992

[54] HUNTING ARROW WITH EXTERNALLY ATTACHED SIGNAL-GENERATING MEANS

[75] Inventors: Ronnel J. Stacey, Idaho Falls; Terry B. Roundy, Teton, both of Id.

[73] Assignee: Sure Trak, Rexburg, Id.

[21] Appl. No.: 597,183

[22] Filed: Oct. 9, 1990

[51] Int. Cl.[5] ..... F42B 6/04

[52] U.S. Cl. ..... 273/416

[58] Field of Search ..... 273/416, 419–422

[56] References Cited

U.S. PATENT DOCUMENTS

| | | | |
|---|---|---|---|
| 4,405,133 | 9/1983 | Cartwright, Jr. | 273/419 |
| 4,858,935 | 8/1989 | Capson | 273/416 |
| 4,940,245 | 6/1990 | Bittle | 273/416 |
| 5,022,658 | 6/1991 | Burkhart | 273/416 |

OTHER PUBLICATIONS

Bowhunter Magazine Nov., 1984 p. 113 Zwickey Scorpio.

1986 Saunders Successories Catalog Jul., 1986 p. 9 Arrow Penetration Limiter.

*Primary Examiner*—Paul E. Shapiro

*Attorney, Agent, or Firm*—Thorpe, North & Western

[57] ABSTRACT

A hunting arrow which includes a radio transmitter externally attached to the shaft of the arrow for transmitting a signal to a directional locating receiver in order to locate a wounded quarry or spent arrow. In one embodiment, the transmitter is externally attached to the arrow utilizing fastening means such as wire fasteners. In an alternate embodiment, the transmitter is attached to a penetration suppressor that frictionally engages the arrow shaft and includes movable arms to stop penetration of the arrow within the quarry by engagement with a fletching of the arrow.

1 Claim, 2 Drawing Sheets

HUNTING ARROW WITH EXTERNALLY ATTACHED SIGNAL-GENERATING MEANS

FIELD OF THE INVENTION

This device relates to a hunting arrow having a radio transmitting device affixed to the outside of the arrow shaft or nock that will transmit a signal after being shot from a bow so that a directional radio receiver can locate the direction of the quarry or spent arrow.

BACKGROUND OF THE INVENTION

The present invention relates to a hunting arrow, and more specifically to a hunting arrow having signal-generating means, in the form of a transmitter, located on the arrow to enable a bow hunter to locate the arrow after a missed shot, or the wounded animal after a successful shot independent of the location of the arrow.

The bow hunting of big game animals is increasing in popularity in the United States. White-tailed deer, mule deer, elk, antelope and bear are only a few of the species currently being hunted. State-of-the-art hunting arrows typically have a hollow carbon fiber or aluminum shaft and are provided with a removable and interchangeable tip, or "broadhead". The type, size, weight, etc., of a broadhead may be changed depending upon the animal hunted, the weather conditions, the terrain, etc. Such arrows are quite expensive, typically ranging in price from $5.00 to $7.00.

Two distinct problems are common with bow hunters: (1) locating the arrow resulting from a missed shot and (2) locating the injured animal (if an immediate kill is not made) resulting from a successful shot. Even the best of hunters miss their target about 20–25% of the time, and less experienced hunters even more. When shooting from a range of 50–100 yards, it is not uncommon to lose the arrows resulting from errant shots. A typical hunter may lose 10–20 arrows per year, resulting in substantial financial loss. Even more importantly, however, the loss of game resulting from successful shots is significant. While it is possible to drop a smaller animal immediately with a well-placed shot, larger animals such as deer, elk, bear, etc., are seldom instantly killed by an arrow. Whether the arrow passes completely through the animal or remains imbedded therein, the animal may run for from a few hundred yards to miles before either dying or resting.

Hunting arrows have been developed which contain transmitters, enabling a bow hunter with a receiving unit to locate either the arrow after an errant shot, or the quarry after a successful shot, presuming the arrow remains imbedded in the quarry. For instance, U.S. Pat. No. 3,790,948 discloses a battery-powered transmitter located within the broadhead and having a rigid antenna extending through the shaft of the arrow. The arrow of U.S. Pat. No. 4,421,319 includes a transmitting device located within the nock of the arrow. The device may also include an audible signal generator to further aid location of the arrow. U.S. Pat. No. 4,675,683 discloses a transmitter positioned intermediate the arrowhead and the nock of a hunting arrow. The transmitter is provided as an extension of the arrow between the main body of the arrow and the arrowhead. The shaft of the arrow serves as the antenna for the transmitter and the transmitter remains with the arrow at all times.

The foregoing patents have addressed the problem of errant shots and successful shots wherein the arrow remains imbedded in the quarry. In a significant number of cases of successful shots, for relatively smaller animals (such as white-tail deer), the arrow passes completely through the animal, severely injuring but not necessarily immediately incapacitating it. If imbedded, the arrow is usually broken off against trees, rocks, etc., or pulled out by the injured animal. In such cases the animal may run a substantial distance before dying, making it quite difficult to find, even if one of the arrows of the prior art is utilized.

A second problem is that generally the radio transmitter devices are contained *within* the broadhead, shaft, or nock making it a unique, customized, and generally more-expensive arrow. U.S. Pat. No. 4,858,935 issued Aug. 22, 1989, owned by a common assignee, discloses several such embodiments of radio transmitters that are contained within the arrow and detach from the arrow after penetrating the quarry. It would be desirable then to have a transmitter that can be affixed to any arrow, and preferably mounts external to the arrow so that a specially formed arrow is not required for its use.

SUMMARY OF THE INVENTION

Accordingly, the present invention provides a means for emplacing a signal-generating device (or transmitter) within the quarry and which can be attached externally to any type of arrow. In a second embodiment, a transmitter attached to a penetration limiter or suppressor prevents the arrow from passing completely through the quarry, enabling it to be located by a corresponding receiver.

Therefore, an arrow constructed in accordance with the present invention, in its broadest embodiment includes a signal-generating means which is firmly affixed externally to the arrow. The arrow may be constructed to not completely penetrate and remain along with the signal-generating means within the quarry.

The signal-generating means or transmitter may be affixed to the shaft of any arrow with a fastening means constructed in accordance with the invention. Alternately, the transmitter may be slidably affixed external to a hunting arrow shaft to a commercially available penetration limiter. A penetration limiter is a circular, flexible, ring-like device to prevent complete penetration of the arrow into the quarry. The penetration device is placed over the shaft behind the broadhead. The penetration limiter typically includes movable arms that fasten to the broadhead. The arms are constructed to stay in position during the shooting acceleration period of the arrow; but upon contact of the arrow with the quarry's hide or skin, the arms spring out and the arrow slides through the penetration limiter. The arrow is restrained at the point of contact between the penetration limiter and the fixed fletching on the arrow shaft.

In another embodiment, the transmitter may be fabricated within a specially manufactured penetration limiter. This penetration limiter may frictionally grip the arrow shaft. Upon penetration of the hide or skin of a quarry, the arrow slides through the penetration limiter until the limiter contacts the fletching and further movement into the quarry is prevented.

The transmitter utilized herein may be actuated manually prior to making the shot, automatically actuated upon release of the arrow from the drawn bow string, or actuated upon impact with the quarry. Preferably, the transmitter generates a pulsating signal which may be received at distances of up to two miles. The signal may then be tracked by a receiver carried by the hunter to locate the arrow which, for a successful shot, will be embedded in the quarry.

Other objects, advantages, and capabilities of the present invention will become more apparent as the description proceeds.

DETAILED DESCRIPTION OF THE INVENTION

In general, the present invention is directed to a hunting arrow in which a radio transmitter is externally mounted to the shaft of the arrow. In a preferred embodiment, the transmitter includes a mounting means for attachment to any type of arrow shaft. In alternate embodiments, the transmitter may be attached to a commercially available penetration limiter or to a specially constructed penetration limiter.

Figure 1:
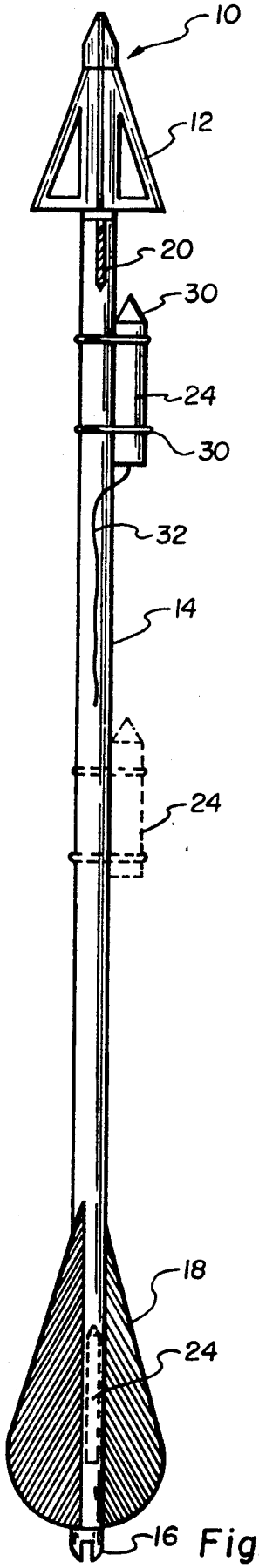
FIG. 1 is a side elevation view of a hunting arrow having a transmitter constructed in accordance with the invention.

FIG. 1 illustrates a hunting arrow generally designated 10. The hunting arrow 10 includes a broadhead 12, a shaft 14, a nock 16, and a fletching 18. The broadhead 12 is removably affixed to the shaft 14 by internal threads 20 to permit the interchange of various broadheads depending upon the particular conditions. The transmitter of the present invention, designated 24, may be securely externally affixed to the shaft 14 between the broadhead 12 and the nock of the arrow 10. The transmitter 24 may be mounted adjacent to the broadhead 12, as shown in FIG. 1 or as shown in dotted lines mounted along an intermediate point of the shaft 14. Alternately, the transmitter 24 may be mounted as shown by dotted lines in FIG. 1 within the fletching 18 of the arrow adjacent to the nock 16. In these embodiments, an archer need not purchase a specially constructed arrow as the transmitter 24 can be attached to the arrow 10 in accordance with the invention with suitable fastening means. One such suitable fastening means includes a wire 30, banding the transmitter to the shaft 14. An antenna wire 32 can be likewise attached to the shaft 14 in this embodiment utilizing wire, adhesive, tape, or other suitable fastening means.

Figure 2:
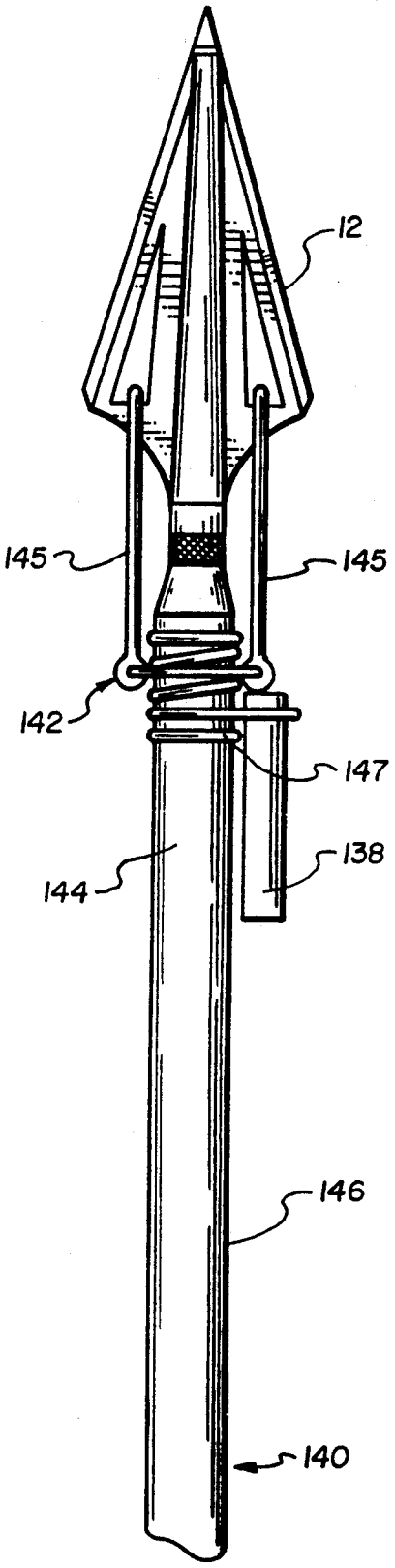
FIG. 2 is a side elevation view of another embodiment of the present invention showing a transmitter attached to a commercially available penetration limiter.

FIG. 2 illustrates a second embodiment of the invention. In this embodiment, a transmitter 138 is secured externally to an arrow 140 attached to a penetration limiter 142 or suppressor. The penetration limiter 142 is attached adjacent to a tip portion 144 of the arrow 10. The penetration limiter 142 is constructed to grip the shaft 144 and broadhead 12 until engagement with the quarry causes arms 145 on the penetration limiter 142 to disengage the broadhead 12 and rotate perpendicular to the shaft to contact the quarry's hide. Penetration limiters 142 constructed in this manner are well known in the art. A friction fit between the shaft 144 and an O-ring device 147 holds the penetration limiter 142 and transmitter 138 in place on the shaft 144 until the arrow 10 contacts the quarry. Upon arrow 10 contact, the arms 145 rotate out and the arrow shaft 146 slides through the penetration limiter 142 until the limiter 142 contacts and is stopped by the fletching of the arrow. The transmitter 138 can be attached to the penetration limiter 142 by suitable fastening means. The penetration limiter 142 can then be inserted over shaft 144 by unthreading the broadhead 12 at internal threads 20 (FIG. 1).

Figure 3:
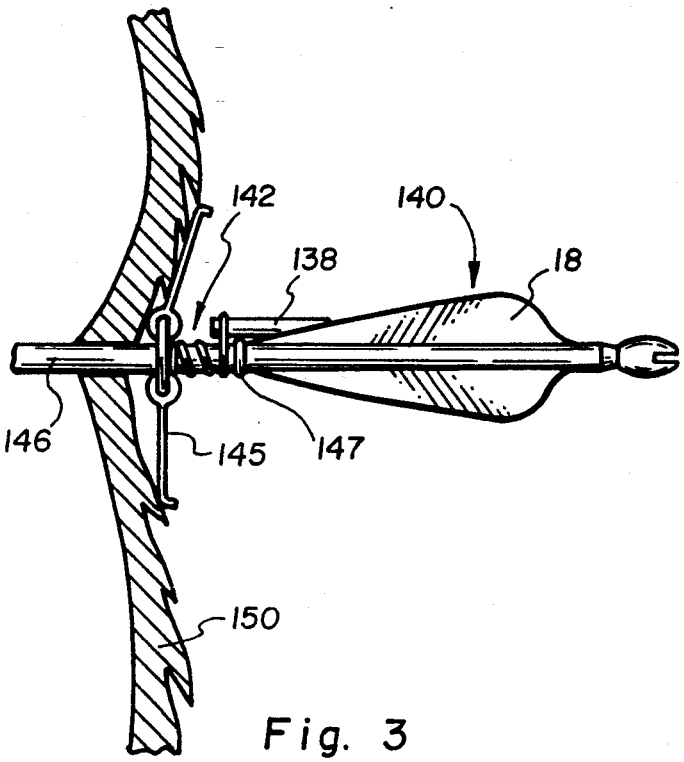
FIG. 3 is a cross-sectional view of the hunting arrow of FIG. 2 imbedded in a target animal.

Referring now to FIG. 3, the arrow 140 is shown imbedded in a quarry's hide 150 with the transmitter 138 and penetration limiter 142 in contact with fletching 18, which has restrained and stopped forward motion of the arrow 140 into the quarry. In this view, the arms 145 are shown in an extended position after engaging the hide 150.

Figure 4:
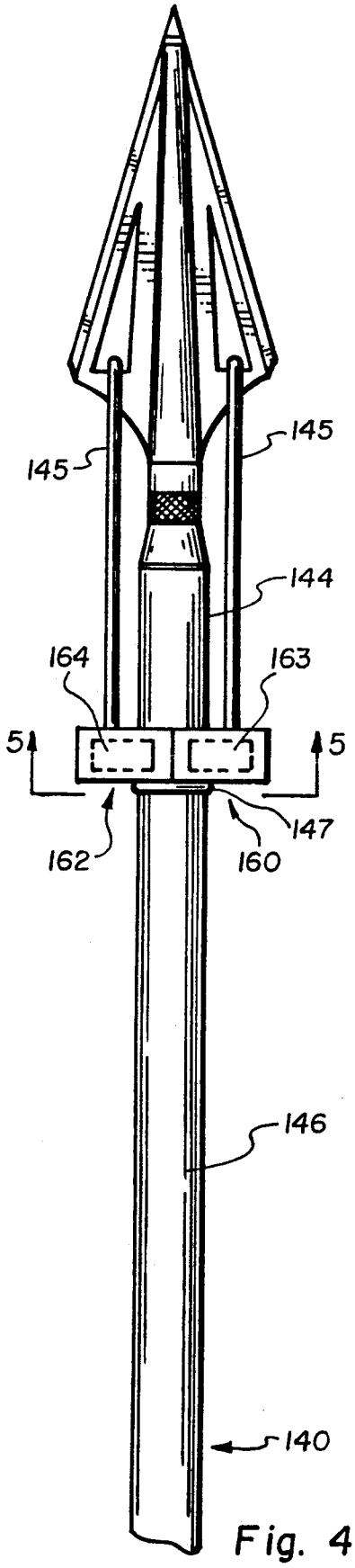
FIG. 4 is a side elevation view of another embodiment of a hunting arrow having a transmitter attached to a penetration limiter constructed in accordance with the present invention.
Figure 5:
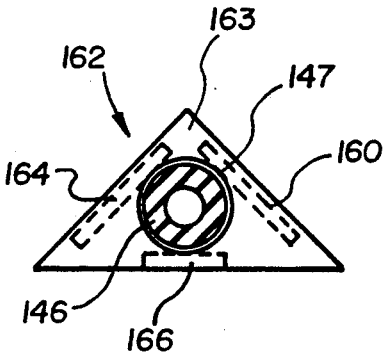
FIG. 5 is a sectional view taken along section lines 5—5 of FIG. 4.

FIGS. 4 and 5 show another embodiment of the invention. In the embodiment of FIGS. 4 and 5, the transmitter 160 is incorporated within a specially constructed penetration limiter 162. As shown in FIG. 5, the penetration limiter 162 has a generally triangular-shaped, cross-sectional housing 163. The cross-sectional shape could also include square or ring shapes. The penetration limiter housing 163 contains a transmitter battery 164, a transmitter 160, and an activation switch 166. As previously described for penetration limiter 142, the penetration limiter 162 remains in place at the forward portion 144 of arrow 140 until contact with the animal's hide. Contact causes the arrow to slide through the penetration limiter until the penetration limiter 162 contacts the fletching of the arrow restraining further motion of the arrow into the quarry.

The transmitter is battery operated and may be actuated either manually at any point prior to shooting the arrow or may be actuated by inertia-type switches upon releasing the arrow from the bow (acceleration) or upon impact with the target animal (deceleration). It would appear that, if cost is no factor, an inertia-type switch activated upon releasing the arrow from a drawn bow is preferable since the battery life is conserved until the arrow is actually fired, and the transmitter will be actuated even without sudden impact with the quarry, tree, ground, etc. Alternatively, an inertia-type switch which is activated upon impact with the quarry, ground, etc. may be utilized.

The transmitter should produce a signal which may be received at distances of up to at least two miles. The transmitter may be preset with a code which can be entered into the receiver to ensure picking up only the desired signal, as is commonplace in, for instance, garage door openers.

The antenna may be constructed of any suitably flexible metallic substance capable of functioning as an antenna.

The archer will preferably be provided with a direction-finding receiver having a directional antenna. The receiver is tuned to the appropriate preset frequency of the transmitter so that the direction and distance from the transmitter may be calculated and displayed.

While preferred embodiments of the invention have been disclosed, various modes of carrying out the principles disclosed herein are contemplated as being within the scope of the following claims. Therefore, it is understood that the scope of the invention is not to be limited except as otherwise set forth in the claims.

What is claimed is:

1. In an archer's arrow having a shaft, a tip a nock, and a fletching, a signal-generating means for external attachment to the arrow comprising:

attachment means for externally attaching the signal-generating means to the shaft of the arrow between the tip and nock said attachment means comprising a wire fastener for attaching the signal generating means to the shaft; and an adhesive for bonding an antenna of the signal generating means to the shaft.

* * * * *